US009109474B2

(12) United States Patent
Kuffner et al.

(10) Patent No.: US 9,109,474 B2
(45) Date of Patent: Aug. 18, 2015

(54) CAMSHAFT ADJUSTING MEANS

(71) Applicant: MAGNA Powertrain AG & Co KG, Lannach (AT)

(72) Inventors: Felix Kuffner, Linz (AT); Michael Schober, Behamberg (AT); Thomas Wickgruber, Linz (AT)

(73) Assignee: Magna Powertrain AG & Co KG, Lannach (AT)

( * ) Notice: Subject to any disclaimer, the term of this patent is extended or adjusted under 35 U.S.C. 154(b) by 0 days.

(21) Appl. No.: 14/348,991

(22) PCT Filed: Sep. 19, 2012

(86) PCT No.: PCT/EP2012/068453
§ 371 (c)(1),
(2) Date: Apr. 1, 2014

(87) PCT Pub. No.: WO2013/060532
PCT Pub. Date: May 2, 2013

(65) Prior Publication Data

US 2014/0290607 A1 Oct. 2, 2014

(30) Foreign Application Priority Data

Oct. 27, 2011 (DE) ..... 10 2011 117 026

(51) Int. Cl.
*F01L 1/34* (2006.01)
*F01L 1/344* (2006.01)
*F01L 1/352* (2006.01)

(52) U.S. Cl.
CPC ..... *F01L 1/34403* (2013.01); *F01L 1/352* (2013.01)

(58) Field of Classification Search
CPC ..... F01L 1/34403; F01L 1/352
USPC ..... 123/90.17
See application file for complete search history.

(56) References Cited

U.S. PATENT DOCUMENTS 7,624,710 B2 * 12/2009 Uehama et al. ..... 123/90.17
2004/0187819 A1 9/2004 Takenaka

FOREIGN PATENT DOCUMENTS

DE 102004041751 A1 3/2006
DE 102008043689 A1 5/2009

OTHER PUBLICATIONS

International Search Report mailed Dec. 11, 2012 (PCT/EP2012/068453).

* cited by examiner

*Primary Examiner* — Zelalem Eshete
(74) *Attorney, Agent, or Firm* — Dickinson Wright PLLC

(57) ABSTRACT

A camshaft adjusting means for an internal combustion engine includes an adjusting mechanism which is configured as a three-shaft gear mechanism having a drive side into which the drive moment for the camshaft is introduced, an output side which is connected fixedly to the camshaft so as to rotate with it, and an adjusting shaft which is coupled to a drive motor and via which a moment which brings about the relative rotation of the drive side with respect to the output side is introduced into the adjusting mechanism. The adjusting mechanism having one bearing point on each of its drive side and its output side and being mounted via the bearing points with respect to the component which supports the camshaft, in particular the cylinder head of the internal combustion engine. The adjusting shaft is guided into the adjusting mechanism through one of the bearing points.

10 Claims, 2 Drawing Sheets

CAMSHAFT ADJUSTING MEANS

CROSS-REFERENCE TO RELATED APPLICATIONS

This application is a U.S. National stage of International Application No. PCT/EP2012/068453 filed Sep. 19, 2012 which claims priority to German Application No. DE102011117026.3 filed Oct. 27, 2011. The entire disclosure of each of the above applications is incorporated herein by reference.

TECHNICAL FIELD

The invention relates to a camshaft adjusting means for an internal combustion engine, consisting of an adjusting mechanism which is configured as a three-shaft gear mechanism, having a drive side, into which the drive moment for the camshaft is introduced, an output side which is connected fixedly to the camshaft so as to rotate with it, and an adjusting shaft which is coupled to a drive motor and via which a moment which brings about the relative rotation of the drive side with respect to the output side is introduced into the adjusting mechanism, the adjusting mechanism having in each case one bearing point on its drive side and its output side and being mounted via said bearing points with respect to the component which supports the camshaft, in particular the cylinder head of the internal combustion engine, the adjusting shaft being guided into the adjusting mechanism through one of the bearing points.

BACKGROUND

DE 10 2005 018 956 A1 or DE 102 48 355 A1 has disclosed an electric camshaft adjuster of an internal combustion engine. The camshaft is driven at half speed from the crankshaft, to which end a camshaft drive gear of the camshaft is coupled to the crankshaft. An adjusting mechanism between the camshaft and the camshaft drive gear permits an adjustment of the phase position of the camshaft drive gear and the camshaft. The adjusting mechanism can be configured, for example, as a double planetary gear mechanism or as a harmonic drive mechanism.

The adjusting motor (electric motor) for the adjusting mechanism, which adjusting motor is mounted fixedly on the internal combustion engine, makes a radial balancing clutch necessary between the motor shaft of the electric motor and the input shaft of the adjusting mechanism, as is shown in DE 10 2005 018 956 A1.

DE 103 52 255 A1 discloses a camshaft adjuster having an adjusting drive which is configured as a three-shaft gear mechanism. The electric motor is arranged spatially separately from the adjusting shaft of the adjusting mechanism; the adjusting moment is transmitted by a flexible shaft. One variant provides that the motor and the motor shaft lie parallel to the camshaft and the adjusting moment is introduced via a secondary drive which is configured as a chain drive, belt drive or the like.

SUMMARY

It is the object of the present invention to propose a camshaft adjusting means having a three-shaft gear mechanism and a stationary drive motor in an embodiment which is improved in comparison with the known solutions.

This object is achieved by way of a camshaft adjusting means for an internal combustion engine, comprised of an adjusting mechanism which is configured as a three-shaft gear mechanism, having a drive side, into which the drive moment for the camshaft is introduced, an output side which is connected fixedly to the camshaft so as to rotate with it, and an adjusting shaft which is coupled to a drive motor and via which a moment which brings about the relative rotation of the drive side with respect to the output side is introduced into the adjusting mechanism, the adjusting mechanism having in each case one bearing point on its drive side and its output side and being mounted via the bearing points with respect to the component which supports the camshaft, in particular the cylinder head of the internal combustion engine, the adjusting shaft being guided into the adjusting mechanism through one of the bearing points.

The following is provided for the camshaft adjusting means in accordance with the invention: the adjusting mechanism which is configured as a three-shaft gear mechanism has in each case one bearing point on its drive side and its output side and is mounted via said bearing points with respect to the component which supports the camshaft, the cylinder head of the internal combustion engine, the adjusting shaft which introduces the adjusting moment from the drive motor into the adjusting mechanism being guided into the adjusting mechanism through one of the bearing points.

In a development, the following is provided in accordance with the invention.

A hollow shaft is situated on the drive side of the adjusting mechanism, the adjusting shaft being introduced into the adjusting mechanism through the hollow shaft. The hollow shaft can be an extension of the camshaft which is configured as a separate component, as a hollow shaft part, and extends the camshaft.

The output side of the adjusting mechanism is configured as a hollow shaft, the adjusting shaft being guided into the adjusting mechanism through the camshaft of hollow configuration and the output side. In this embodiment, the introduction of the torque which brings about the adjustment takes place from the other end of the camshaft via an adjusting shaft which runs within the camshaft.

The output side is connected directly to the camshaft and is thus mounted via a bearing which supports the camshaft at its end region. Here, the bearing which is assigned to the output side and supports the output side is formed by the camshaft bearing.

The output side is connected to the camshaft via a flange connection. The adjusting drive in accordance with the invention can thus be attached retrospectively to the camshaft.

The output side is connected via a shaft part which is connected fixedly to the camshaft. Here, the output side is connected via an extension to the camshaft, and is coupled to the latter. It can be provided here that the mounting which is assigned to the output is formed by the camshaft bearing or by a bearing which supports the extension.

The mounting of the drive side takes place via an extension of the camshaft, which extension is configured, in particular, as a separate component, is guided through the adjusting mechanism, and on which a drive gear, via which the drive moment for the camshaft is introduced, is mounted rotatably. This embodiment provides the mounting of the drive gear on the extension of the camshaft, which extension is configured, in particular, as a hollow shaft part.

The mounting of the drive side takes place by way of a hollow shaft which is connected fixedly to the camshaft so as to rotate with it, through which hollow shaft the adjusting shaft is guided into the adjusting mechanism. An introduction which is simple to design of the adjusting shaft into the gear mechanism takes place as a result of this precise fixing of the adjusting mechanism.

The mounting of the drive side is seated in a bearing seat part which is fastened directly in or on a wall of an internal combustion engine. Depending on the design of the cylinder head or the receiving and fastening options to be provided for the mounting, the bearing can be arranged directly in the cylinder head wall or a receiving part which can be fastened to the cylinder head.

The drive motor is oriented via a centering means with respect to the wall of the internal combustion engine or the bearing seat part. As a result of the provided mounting on the cylinder head side of the drive side and the output side, the drive motor and the adjusting shaft can be oriented with respect to the gear mechanism by way of simple centering means.

Below, the explanation of one exemplary embodiment of the invention takes place using the drawings.

DRAWINGS

The drawings described herein are for illustrative purposes only of one exemplary embodiment wherein.

DESCRIPTION

Figure 1:
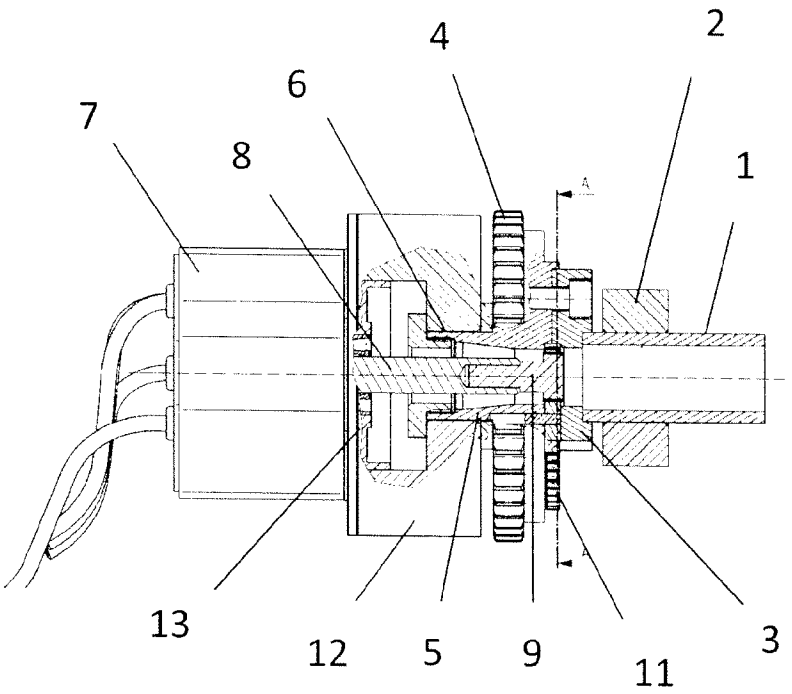
FIG. 1 is a partial sectional view of a camshaft adjusting means constructed in accordance with the present invention.

FIG. 1 illustrates a section through the camshaft adjusting means in accordance with the invention. A camshaft 1 of hollow configuration (or a shaft part which extends the camshaft and is connected fixedly to the latter) is received at its one end in a bearing 2 which mounts the camshaft 1 with respect to the cylinder head of an internal combustion engine (not illustrated in further detail). That end of the camshaft 1 which protrudes through the bearing 2 is connected fixedly to the output 3, configured as a flange, of an adjusting mechanism so as to rotate with it.

The camshaft 1 is driven by the crankshaft of the internal combustion engine via a drive gear 4 via a gear train (not illustrated). The drive gear 4 which forms the drive side of the adjusting mechanism is seated in a rotatably mounted manner on a short hollow shaft, a hollow shaft part 5, which is connected directly to the output 3 and therefore the camshaft 1. The hollow shaft part 5 is mounted rotatably in a bearing seat part 12 via a bearing point 6, the bearing seat part 12 being let into a wall of the cylinder head or being fastened to the wall of the cylinder head. As illustrated, in each case one bearing point 2, 6 is therefore situated on the drive side and the output side of the adjusting mechanism.

A drive motor 7 which is configured as an electric motor is seated outside the cylinder head and, via an adjusting shaft 8 which is configured as an extension of the motor shaft 8, introduces the torque which is necessary for the relative rotation of the drive side and the output side into the adjusting mechanism. Here, the adjusting shaft 8 reaches through the bearing 6 which supports the hollow shaft part 5 and the hollow shaft part 5 itself, and is connected at its end which is situated in the adjusting mechanism to a pinion 9 which, via intermediate gears 10, drives the spur gears 11 of a preliminary gear mechanism, via which the adjusting movement, the rotation between the drive gear 4 and the output 3, then takes place in a gear mechanism part which is not illustrated here and is constructed in a manner which is known per se.

Figure 2:
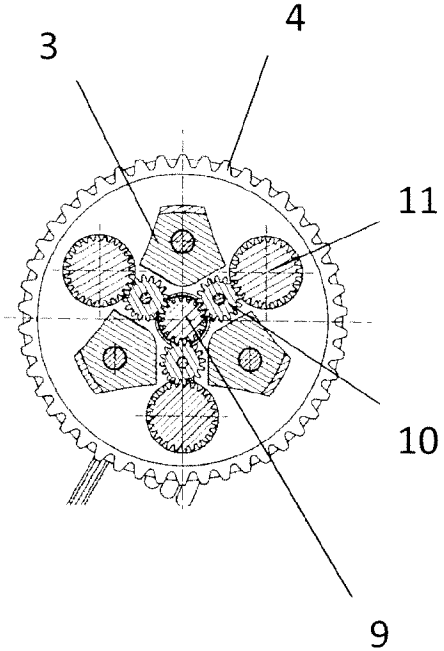
FIG. 2 is a sectional view generally taken along line A-A of FIG. 1.

FIG. 2 illustrates the section A-A in accordance with FIG. 1 and illustrates parts of the flange which forms the output 3, the pinion 9 which is driven by the adjusting shaft, the intermediate gears and the spur gears 11 of the preliminary gear mechanism.

The drive motor 7, the stator, is oriented with respect to the cylinder head and therefore the bearing point 6 which supports the hollow shaft part 5 via a centering means 13 which is configured as a disk and is inserted into an end-side opening of the bearing seat part 12 or the cylinder head wall. The centering means 13 brings about the coaxial orientation of the motor or adjusting shaft 8 and of the further gear mechanism parts. The adjusting shaft 8 reaches through a central opening of the centering means 13. A sealing means is arranged between the adjusting shaft 8 and the centering means 13, in order to prevent the escape of engine oil.

Figure 3:
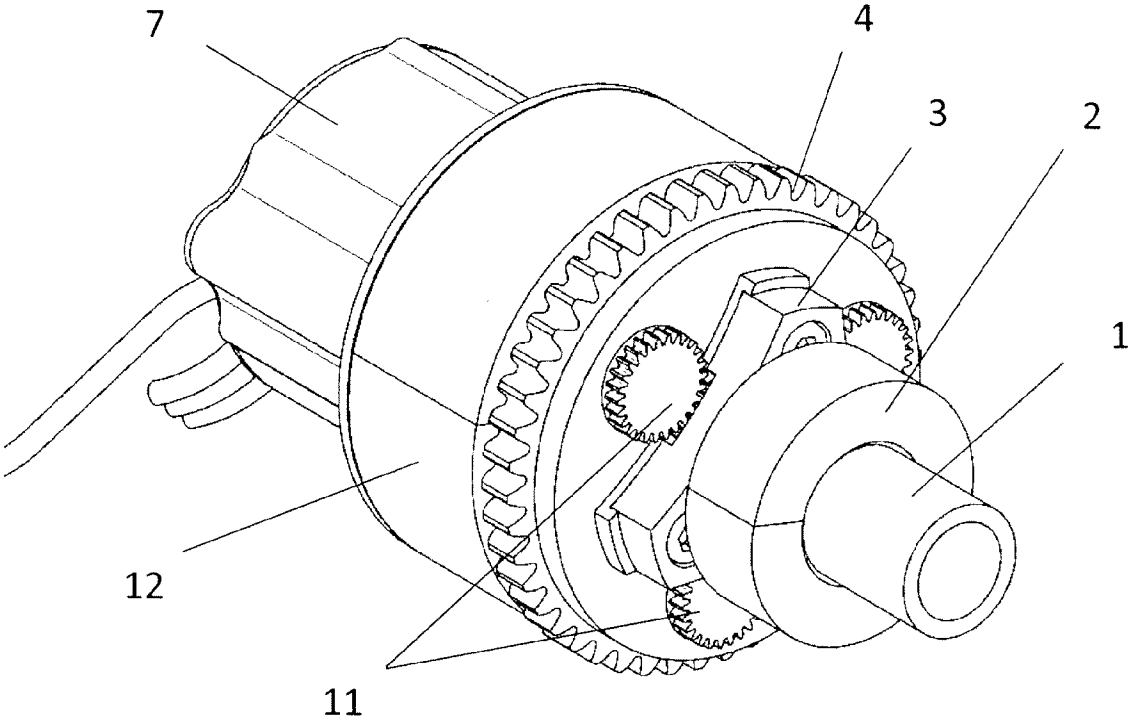
FIG. 3 is a perspective view of the camshaft adjusting mechanism shown in FIGS. 1 and 2.

FIG. 3 is a perspective view of the camshaft adjuster of compact construction. Here, the bearing seat part 12 which supports the drive motor 7 is illustrated cylindrically in a simplified manner and is attached to a cylinder head (not illustrated) or is inserted into a seat which is provided there. The flange which forms the output 3 of the adjusting mechanism is connected directly to the camshaft 1 or to a shaft part which is connected fixedly to the camshaft. The camshaft 1 which ends at the flange or the shaft part which extends said camshaft 1 is guided through a bearing 2 which is seated in a bearing seat of a cylinder head (not illustrated). In the way which is described, the adjusting mechanism has in each case one bearing point 6, 2 on its drive side and its output side and is mounted via said bearing points 6, 2 with respect to the component which supports the camshaft 1, the cylinder head of the internal combustion engine.

What is claimed is:

1. A camshaft adjusting means for an internal combustion engine, comprising an adjusting mechanism which is configured as a three-shaft gear mechanism, having a drive side, into which the drive moment for a camshaft is introduced, an output side which is connected fixedly to the camshaft so as to rotate with it, and an adjusting shaft which is coupled to a drive motor and via which a moment which brings about the relative rotation of the drive side with respect to the output side is introduced into the adjusting mechanism, the adjusting mechanism having in each case one bearing point on its drive side and its output side and being mounted via said bearing points with respect to the cylinder head of the internal combustion engine which supports the camshaft, the adjusting shaft being guided into the adjusting mechanism through one of the bearing points.

2. The camshaft adjusting means as claimed in claim 1, wherein a hollow shaft is situated on the drive side of the adjusting mechanism, the adjusting shaft being introduced into the adjusting mechanism through the hollow shaft.

3. The camshaft adjusting means as claimed in claim 1, wherein the output side of the adjusting mechanism is configured as a hollow shaft, the adjusting shaft being guided into the adjusting mechanism through the camshaft of hollow configuration and the output side.

4. The camshaft adjusting means as claimed in claim 1, wherein the output side is connected directly to the camshaft and thus is mounted via a bearing which supports the camshaft at its end region.

5. The camshaft adjusting means as claimed in claim 1, wherein the output side is connected to the camshaft via a flange connection.

6. The camshaft adjusting means as claimed in claim 1, wherein the output side is connected via a shaft part which is connected fixedly to the camshaft.

7. The camshaft adjusting means as claimed in claim 1, wherein the mounting of the drive side takes place via an extension of the camshaft, which extension is configured, in particular, as a separate component, on which a drive gear, via which the drive moment for the camshaft is introduced, is mounted rotatably.

8. The camshaft adjusting means as claimed in claim 2, wherein the mounting of the drive side takes place by way of a hollow shaft which is connected fixedly to the camshaft so as to rotate with it, through which hollow shaft the adjusting shaft is guided into the adjusting mechanism.

9. The camshaft adjusting means as claimed in claim 1, wherein the mounting of the drive side is seated in a bearing seat part which is fastened directly in or on a wall of an internal combustion engine.

10. The camshaft adjusting means as claimed in claim 9, wherein the drive motor is oriented via a centering means with respect to the wall of the internal combustion engine or the bearing seat part.

* * * * *